United States Patent [19]

Yu

[11] Patent Number: 4,911,656

[45] Date of Patent: Mar. 27, 1990

[54] SOCKET ASSEMBLY FOR ELECTRIC LAMPS

[76] Inventor: Kuang-Shih Yu, Fl. 10, No. 546, Min-Chuan East Rd., Taipei, Taiwan

[21] Appl. No.: 336,468

[22] Filed: Apr. 12, 1989

[51] Int. Cl.[4] ..... H01R 4/24

[52] U.S. Cl. ..... 439/425

[58] Field of Search ..... 439/389–425

[56] References Cited

U.S. PATENT DOCUMENTS 1,501,106 7/1924 Gaillemin ..... 439/425

2,164,381 7/1939 Bradley ..... 439/425

*Primary Examiner*—Joseph H. McGlynn

*Attorney, Agent, or Firm*—McGlew & Tuttle

[57] ABSTRACT

An improved socket assembly for electric lamps with a usual conductive screwshell and a positive terminal connected with an insulating plate for receiving and holding a lamp base therein includes a combination of a wire mounting seat and a separate coupling member. The wire mounting seat is integrally formed with an upper open mount and a lower base being fixed on top of the screwshell. The upper open mount includes an open section in the middle, a plurality of coupling flanges on the top edge and a pair of piercing terminals disposed for connecting an electrical cord therewith. The separate coupling member includes a pair of sliding channels on the opposing sides and a sliding guide in the middle portion for being slidingly engaged with the upper open mount along the coupling flanges. In this way, with an electrical cord placed in the upper open mount, by sliding the separate coupling member along the coupling flanges, electrical connections will be effected without requiring screw and wire stripping operations.

3 Claims, 4 Drawing Sheets

SOCKET ASSEMBLY FOR ELECTRIC LAMPS

BACKGROUND OF THE INVENTION

This invention relates to a socket assembly for electric lamps, and particularly to an improved type of socket assembly having a wire mounting seat and a separate coupling member combined for making convenient electrical connections without requiring screw and wire stripping operations.

Generally, socket assemblies for electric lamps are divided into two types according to wire connections—a screw-terminal type and a piercing-terminal type. In the former, electrical cords have to be stripped at one end for connecting the bare wire strands thereof to the socket terminals with the attached screws while in the latter the electrical cords can be directly connected to the socket piercing terminals without requiring screw and wire stripping operations.

A typical example of the piercing-terminal type of socket assembly is shown in U.S. Pat. No. 4,579,258, issued to Walter H. Anthony. The main feature of this patent includes the arrangement of the piercing terminals and a pivoted cover which can be closed over the piercing terminals with an attached screw bolt for effecting electrical connections. However, since the above-identified patent still requires a screw connection to be made for the pivoted cover, use of such a socket assembly is still inconvenient.

In order to overcome the foregoing shortcoming, the applicant designed a novel socket assembly which does not require screw connection. The application for said novel socket assembly was filed in the United States on Sept. 15, 1987 under Ser. No. 97,511 and was patented on Nov. 1, 1988 under U.S. Pat. No. 4,781,616. After a period of practical usage, however, it was discovered that improvement in regards to the structure of said novel socket assembly could still made. For example, when said novel socket assembly is used for a certain time and the electrical cord connected thereto has to be replaced, it is difficult to open the movable coupling member. Consequently, when opened and closed several times, the front engaging flange of the movable coupling member may be impaired and eventually inoperative.

SUMMARY OF THE INVENTION

It is accordingly a primary object of the present invention to provide an improved socket assembly for electric lamps with a wire mounting seat for facilitating the connection operations of an electrical cord.

It is another object of the present invention to provide an improved socket assembly for electric lamps with a separate coupling member for being slidingly engaged with said wire mounting sea in effecting electrical connections therewith.

These and other objects of the present invention are achieved by the provision of an improved socket assembly for electric lamps, which socket assembly comprises a combination of a usual conductive screwshell for receiving and holding a bulb base therein, an insulting member for being fixed on top of said screwshell, a non-conductive wire mounting seat fixed on top of said insulating member for securing an electrical cord therein, and a separate coupling member for being slidingly engage with said non-conductive wire mounting seat in effecting electrical connection therewith; wherein, the structure of said conductive screwshell and the insulating member are identical to those of the above-mentioned U.S. Pat. No. 4,781,616. The non-conductive wire mounting seat according to the present invention is integrally formed with a lower base and an upper open mount which includes coupling flanges formed on the opposing top edges with an L-shaped open section defined in the middle portion. A plurality of engaging blocks are provided on an inner wall of the L-shaped open section for defining an elongated narrow space so as to hold an electrical cord therein and a pair of piercing terminals are disposed over the bottom surface of said open section for making electrical connections therewith. The separate coupling member according to the present invention is provided with a plurality of sliding channels on the opposing sides thereof and a sliding guide in the middle in conjunction with the coupling flanges and the open section of the non-conductive wire mounting seat. Therefore, by placing the electrical cord of an electric lamp in the L-shaped open section of the wire mounting seat against the piercing terminals thereof and by slidingly engaging the separate coupling member with the coupling flanges of the wire mounting seat through the sliding channels and the sliding guide of said separate coupling member, the insulation of said electrical cord will be forced to be cut through by said piercing terminals so that electrical connections for the electric lamp will be conveniently and effectively made accordingly.

Other advantages and characteristic of the present invention will become apparent from the following detailed description of a preferred embodiment of an improved socket assembly for electric lamps when read in conjunction with the accompanying drawings.

DETAILED DESCRIPTION OF THE PREFERRED EMBODIMENT

Figures 1A, 1C:
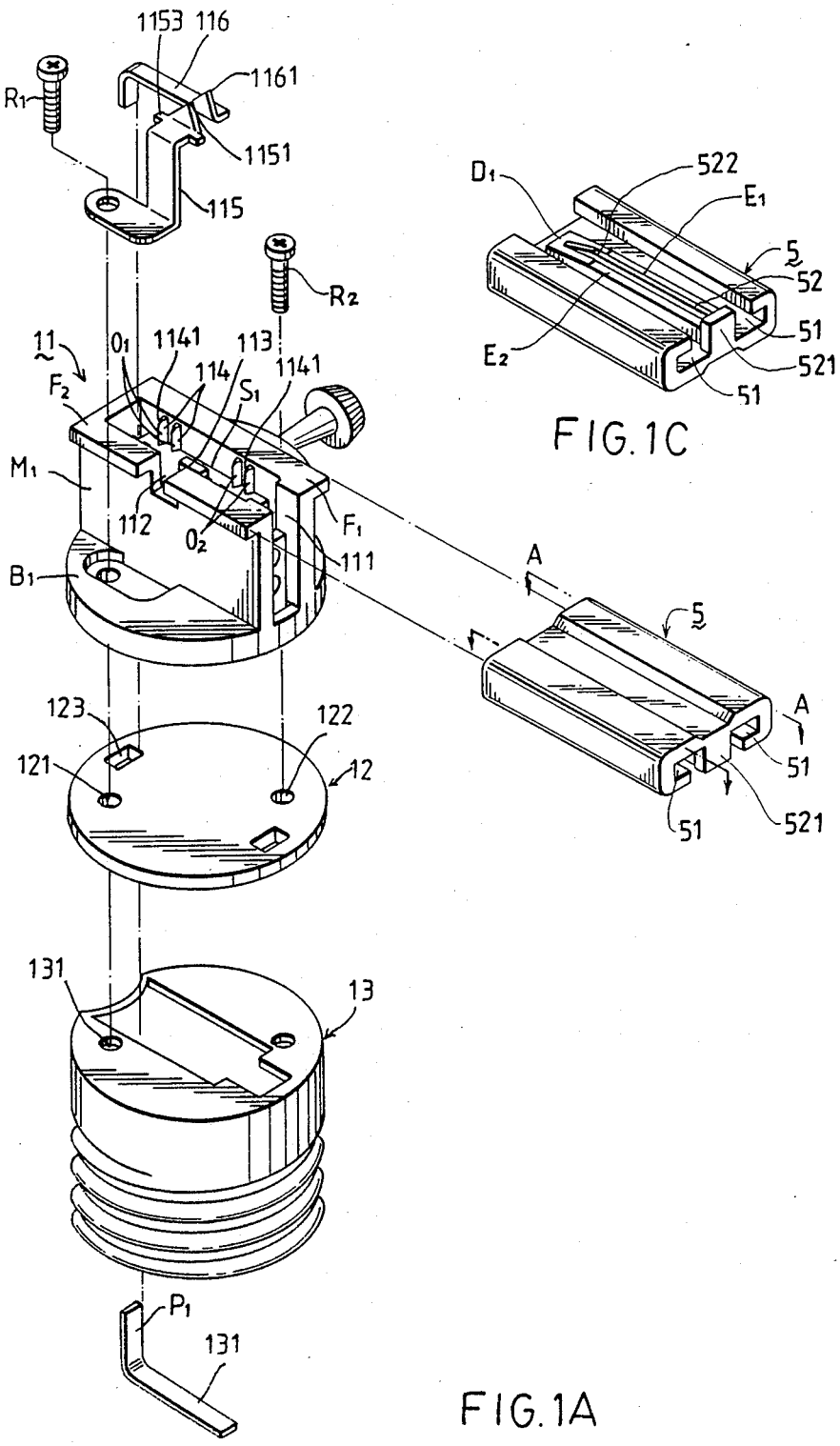
FIG. 1A is an exploded and perspective view of a preferred embodiment of an improved socket assembly for electric lamps according to the present invention.
FIG. 1C is a schematic illustration indicating an inverse side of the separate coupling member of the preferred embodiment shown in FIG. 1A.
Figure 1B:
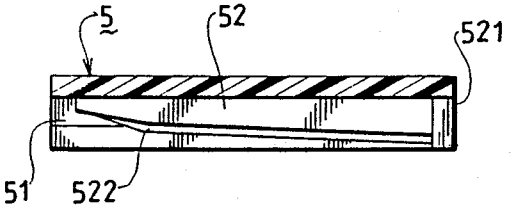
FIG. 1B is a sectional view taken from Line A—A' of a separate coupling member of the preferred embodiment shown in FIG. 1A.

Referring to FIGS. 1A, 1B and 1C, the preferred embodiment of an improved socket assembly for electric lamps according to the present invention comprises a combination of a usual conductive screwshell 13 having a positive terminal 131 disposed in a middle portion of the screwshell 13, an insulating plate 13, a non-conductive wire mounting seat 11 and a separate coupling member 5. Since the structure and disposition of the conductive screwshell 13, the positive terminal 131 and the insulating plate 12 are similar to that of the above-identified U.S. Pat. No. 4,781,616, detailed description is hereby omitted for simplicity.

The non-conductive wire mounting seat 11 is integrally formed with a lower base B1, the circumferential size of which is identical to that of the insulating plate 13, an upper open mount M1 which includes a first coupling flange F1 and a second coupling flange F2 separately located on top of the opposing sides of the open mount M1, and an L-shaped open section S1 formed in the middle portion thereof with a closed end 110 and an open end 111. The open section S1 includes a locating slot 112 formed in one side through said second coupling flange F2, a protrusion 113 provided on the middle of the bottom surface thereof, and a plurality of engaging blocks 114 respectively provided on the internal walls, wherein the engaging blocks 114 are symmetrically situated in pairs and each having an oblique surface 01, 02 formed on the central portion and a tapered plane 1141 on a top end thereof for defining an elongated narrow space in the open section S1.

Figure 3C:
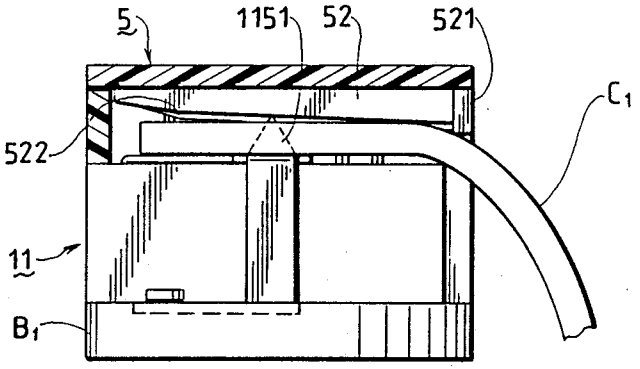
FIG. 3C is a partial sectional view of the combined wire mounting seat and the separate coupling member taken from Line C—C' of FIG. 4.
Figure 3B:
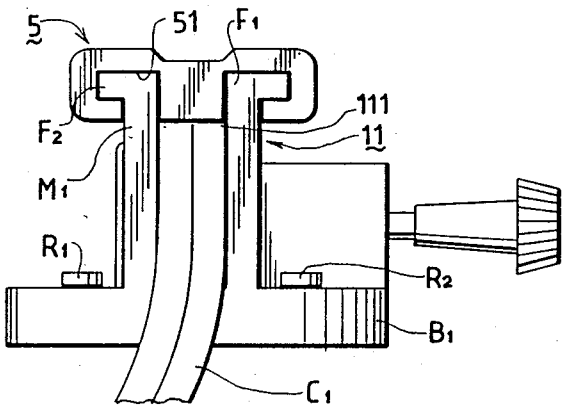
FIG. 3B is a schematic side view of the combined non-conductive wire mounting seat and the separate coupling member of the preferred embodiment shown in FIG. 1A.
Figure 3A:
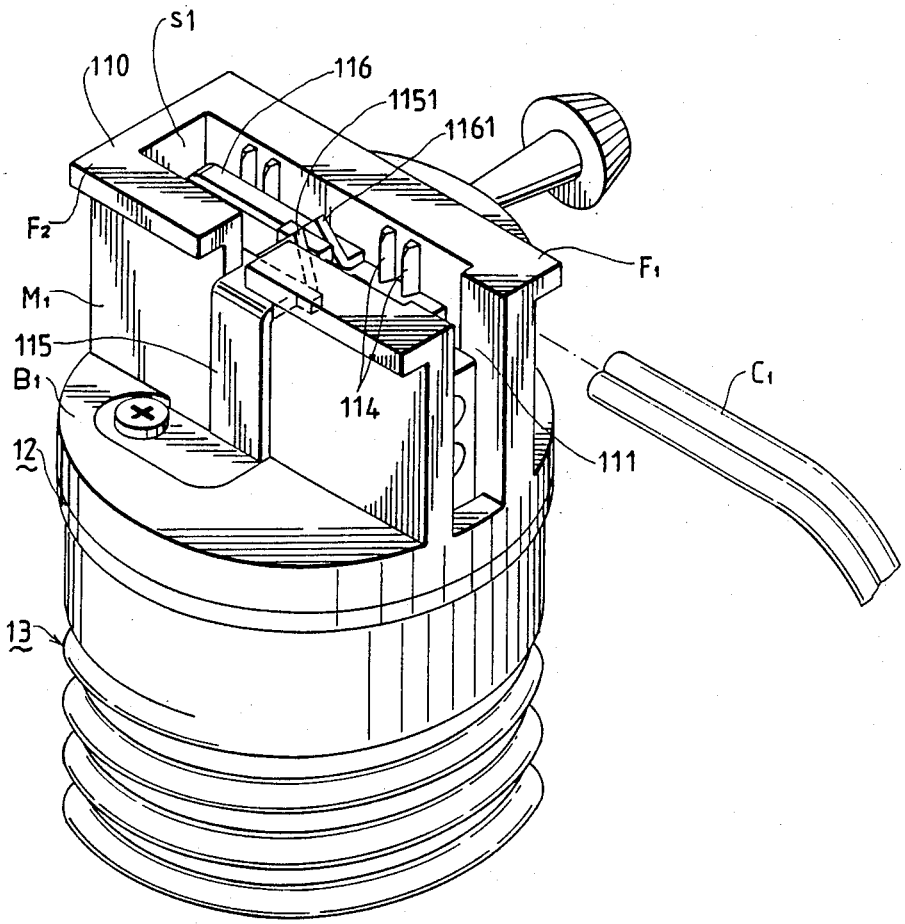
FIG. 3A is a perspective of an assembled non-conductive wire mounting seat of the preferred embodiment shown in FIG. 1A.

Referring to FIG. 3A in connection with FIG. 1A, a negative conductive member 115 and a positive conductive member 116, each having a piercing terminal 1151, 1161 at one end and a connecting portion 1152, 1162 at another end, are respectively fixed at said wire mounting seat 11 the lower base B1 of which is mounted on top of the conductive screwshell 13 through the insulating plate 12 and fastened by a pair of screw rivets R1, R2 through rivet holes 131, 132 of the screwshell 13 and rivet holes 121, 122 of the insulating plate 12, as well as the screw holes 118 (one of which is hidden) of the wire mounting seat 11 and the screw hole of the negative conductive member 115, so as to effect a negative electrical connection with the conductive screwshell 13 wherein the upright portion P1 of the positive terminal 131 extends out of the terminal hole 123 of the insulating plate 12. When the connection of the non-conductive wire mounting seat 11 and the conductive screwshell 13 is made, a neck portion 1153 of the negative conductive member 115 is firmly engaged in the locating slot 112. Then, the end of the connection portion 1162 of the positive conductive member 116, which is inserted into a through opening 117 in the open section S1, is held in close contact with the extended end of th positive terminal 131 so as to effect a positive electrical connection thereat. As can be seen in FIG. 3, when the negative and positive conductive members 115, 116 are installed in the upper open mount M1 of the wire mounting seat 11, the piercing terminals 1151, 1161 of both conductive members 115, 116 are separately located in the open section S1 of the upper open mount M1 with the piercing points extending upward thereat and the bottom surfaces of both piercing terminals 1151, 1161 abutting on the top surface of the protrusion 113 in the open section S1. Therefore, when the end of an electrical cord C1 is placed in the open section S1 and the insulation of the electrical cord C1 is cut through by the piercing terminals 1151, 1161 of the conductive members 115, 116, electrical power can be supplied to the screwshell 13.

Referring to FIGS. 1A, 1B and 1C, the rectangular-shaped separate coupling member 5 includes: a pair of sliding channels 51 located on the opposing sides thereof for being slidingly coupled with the coupling flanges F1, F2 of the upper open mount M1; and a sliding guide 52 provided in a middle portion thereof with a baffle block 521 at one end, (as shown in FIGS. 1B, 1C), a slanted face D1 which is inclined toward another end, and a rib strip 522 on the central area dividing said sliding guide 52 into two sliding surfaces E1, E2 thereat.

Figure 2:
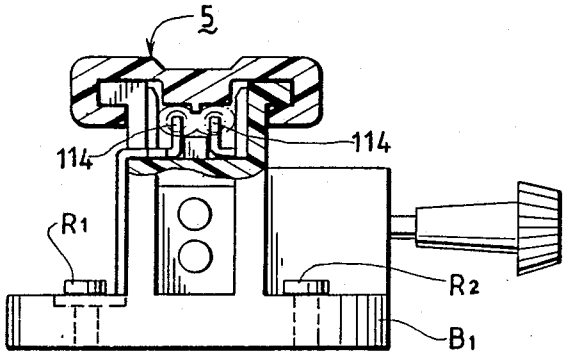
FIG. 2 is a sectional view taken from Line B—B' of the preferred embodiment shown in FIG. 4.
Figure 4:
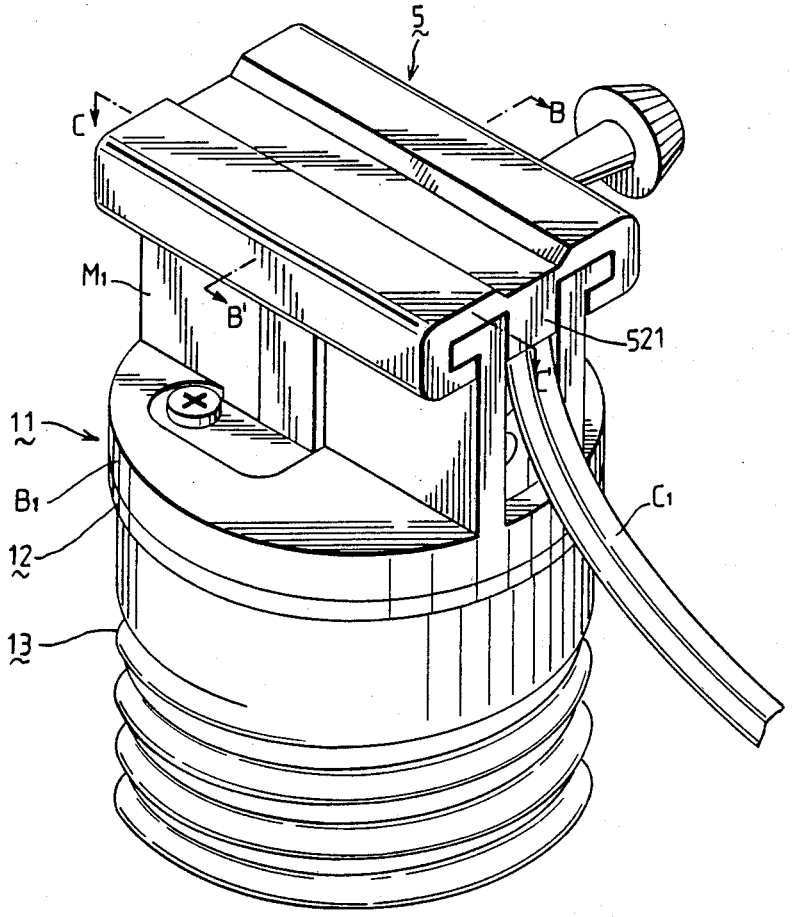
FIG. 4 is a perspective view of the assembled preferred embodiment with electrical connections made for an electric lamp.

Referring to FIGS. 2, 3 (A, B, C) and 4, the assembled wire mounting seat 11 and the screwshell 13 are as shown in FIG. 3A. When an electrical cord C1 (usually a power line) is positioned in the open section S1, placing the slanted face D1 of the separate coupling member 5 at the open side 111 of the open section S1, respectively engaging the sliding channels 51 with the first and second coupling flanges F1, F2 of the upper open mount M1, as shown in FIG. 3B, and pushing the coupling member 5 to slide forward along the first and second coupling flanges F1, F2 until the baffle block 521 abuts upon the electrical cord C1 at the open side 111 and the separate coupling member 5 is tightly engaged with the upper open mount M1 of the wire mounting seat 11, as shown in FIG. 4. It shall be noted that during the sliding movement of the coupling member 5, the electrical cord C1 will be forced down by the sliding guide 52 so that said electrical cord C1 may be firmly positioned in the elongated narrow space defined by the oblique surfaces 01, 02 of the engaging blocks 114 on the opposing internal walls of the open section S1 of the upper open mount M1, and the insulation of the electrical cord C1 is therefore cut through by the respective piercing terminals 1151, 1161, as shown in FIG. 3C, so that electrical connection is effected accordingly.

With the above-described preferred embodiment, electrical connection operation can be simply done by placing the electrical cord C1 in the open section S1 of the upper open mount M1 and slidingly engaging the coupling member 5 with the coupling flanges F1, F2 of the upper open mount M1. In addition, the separate coupling member 5 can be repeatedly assembled and disassembled with great convenience for the replacement of an electrical cord, and the components of the socket assembly can be simply manufactured at a reduced cost.

The foregoing is considered as illustrative only of the principles of the present invention. Furthermore, since numerous modifications and changes will readily occur to those skilled in the art, it is not desired to limit the present invention to the exact construction and operation shown and described. Accordingly, all suitable modifications and equivalents, which may be resorted to, fall within the scope of the present invention as defined in the appending claims.

What is claimed is:

1. An improved socket assembly with a conductive screwshell having a positive terminal fixed in a middle portion for receiving and holding an electric bulb base therein, an insulating plate having a plurality of rivet holes and a terminal opening formed therein fixed on top of the conductive screwshell with one end of the positive terminal extending out of the terminal opening, said socket assembly comprising;

a wire mounting means integrally formed with a lower base in conjunction with the insulating plate and an upper open mount fixedly connected to the conductive screwshell through the insulating plate, said upper open mount having an L-shaped open section formed in a middle portion thereof with a closed end at one side and an open end at another side for receiving an electrical cord therein, and a first coupling flange and a second coupling flange symmetrically provided at opposing edges on top of said upper open mount for making an engagement therewith;

a pair of conductive members each having a piercing terminal at one end and a connecting portion at another end separately installed on said wire mounting means and respectively connected to the conductive screwshell and the positive terminal with the piercing terminal of each conductive member positioned in said L-shaped open section and extending upward thereat for effecting electrical connections therewith; and a rectangular-shaped separate coupling means with a pair of sliding channels located on opposing sides thereof corresponding to said first and second coupling flanges of said wire mounting means and an inclined sliding guide on a middle portion thereof in conjunction with said L-shaped open section for being slidingly engaged with said upper open mount along said first and second coupling flanges; whereby, when an electrical cord is placed in said L-shaped open section of said wire mounting means against said piercing terminals, by slidingly engaging said separate coupling means with said upper open mount, electrical connection for said socket assembly will be effected without requiring screw and wire stripping operations.

2. An improved socket assembly according to claim 1 wherein said upper open mount further comprises:

a protrusion located on a bottom surface of said L-shaped open section for the positioning of said piercing terminals thereon; and a plurality of engaging blocks symmetrically provided on an internal wall of said L-shaped open section, each of said engaging blocks including an oblique surface formed along a central portion and a tapered plane located on a top end thereof so as to define an elongated narrow space in said L-shaped open section for firmly positioning an electrical cord therein against said piercing terminals.

3. An improved socket assembly according to claim 1 wherein said separate coupling means further comprises:

a baffle block provided at one end of said sliding guide for being positioned against said open end of said L-shaped open section when said separate coupling means is slidingly engaged with said upper open mount.

* * * * *